US006716142B2

(12) United States Patent
Kuo

(10) Patent No.: US 6,716,142 B2
(45) Date of Patent: Apr. 6, 2004

(54) TREADMILL, HAVING MOTOR SHIELDING AND PROTECTING DEVICE

(76) Inventor: Hai Pin Kuo, No. 15, Lane 833, Wen Hsien Road, Tainan (TW), 704

( * ) Notice: Subject to any disclaimer, the term of this patent is extended or adjusted under 35 U.S.C. 154(b) by 148 days.

(21) Appl. No.: 10/050,351

(22) Filed: Jan. 18, 2002

(65) Prior Publication Data

US 2003/0139260 A1 Jul. 24, 2003

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,279,528 A 1/1994 Dalebout et al. ..... 482/54
6,045,490 A * 4/2000 Shafer et al. ..... 482/54
6,241,638 B1 * 6/2001 Hurt ..... 482/54
6,478,720 B1 * 11/2002 Barker ..... 482/54

* cited by examiner

*Primary Examiner*—Glenn E. Richman
(74) *Attorney, Agent, or Firm*—Charles E. Baxley

(57) ABSTRACT

A treadmill includes two rollers rotatably secured in a base, an endless belt engaged over the rollers, and a motor disposed in the base and coupled to one of the rollers for driving the endless belt. A shielding device is disposed between the motor and the endless belt for shielding the motor and for preventing the endless belt to carry dust to dirt the motor. The users may carry the dust onto the endless belt, and the dust may then be carried toward the motor, but may be shielded by the shielding device and may be prevented from dirtying the motor.

6 Claims, 3 Drawing Sheets

TREADMILL, HAVING MOTOR SHIELDING AND PROTECTING DEVICE

BACKGROUND OF THE INVENTION

1. Field of the Invention

The present invention relates to a treadmill, and more particularly to a treadmill including a shielding and protecting device for shielding the motor and for preventing the motor from being dirtied by dust or the like.

2. Description of the Prior Art

Typical treadmills comprise an endless belt rotatably supported in a base of the treadmill, and a motor coupled to the endless belt for rotating and driving the endless belt. U.S. Pat. No. 5,279,528 to Dalebout et al. discloses one of the typical treadmills and comprises an endless belt and a motor disposed in the base. The motor is disposed in front of the endless belt. No shielding devices have been provided for shielding and protecting the motor, such that the motor is disposed and located right in front of the endless belt. While in use, dust or the like, particularly the dust applied onto the endless belt by the users may be carried or transported into the base and may dirt the motor, such that the motor may be easily damaged.

The present invention has arisen to mitigate and/or obviate the afore-described disadvantages of the conventional treadmills.

SUMMARY OF THE INVENTION

The primary objective of the present invention is to provide a treadmill including a shielding and protecting device for shielding the motor and for preventing the motor from being dirtied by dust or the like.

In accordance with one aspect of the invention, there is provided a treadmill comprising a base including a middle portion, a first end portion and a second end portion, a first roller rotatably secured in the middle portion of the base, a second roller rotatably secured in the first end portion of the base, an endless belt engaged over the first roller and the second roller, a motor disposed in the second end portion of the base, and coupled to the first roller for driving the first roller and the endless belt, and a shielding device disposed between the motor and the endless belt for shielding the motor and for preventing the endless belt to carry dust to dirt the motor. For example, the users may carry the dust onto the endless belt, and the dust may then be carried or transported toward the motor, but may be shielded or collected by the shielding device and may be prevented from dirtying the motor.

The shielding device includes a frame, and a screen engaged in the frame and disposed between the motor and the endless belt for shielding the motor, and for allowing air to flow into the base to dissipate the heat that may be generated by the motor.

A pair of bars are further provided in the base and disposed between the motor and the endless belt, the shielding device is secured onto the bars.

The base includes a fence provided between the motor and the endless belt, the bars are secured onto the fence.

A cover is further provided and secured onto the second end portion of the base for shielding the motor and the other elements, the bars are secured onto the cover.

The bars each includes at least one reinforcing rib extended therefrom for reinforcing purposes.

The bars each includes a bracket extended therefrom for engaging with the shielding device and for positioning the shielding device to the bars.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
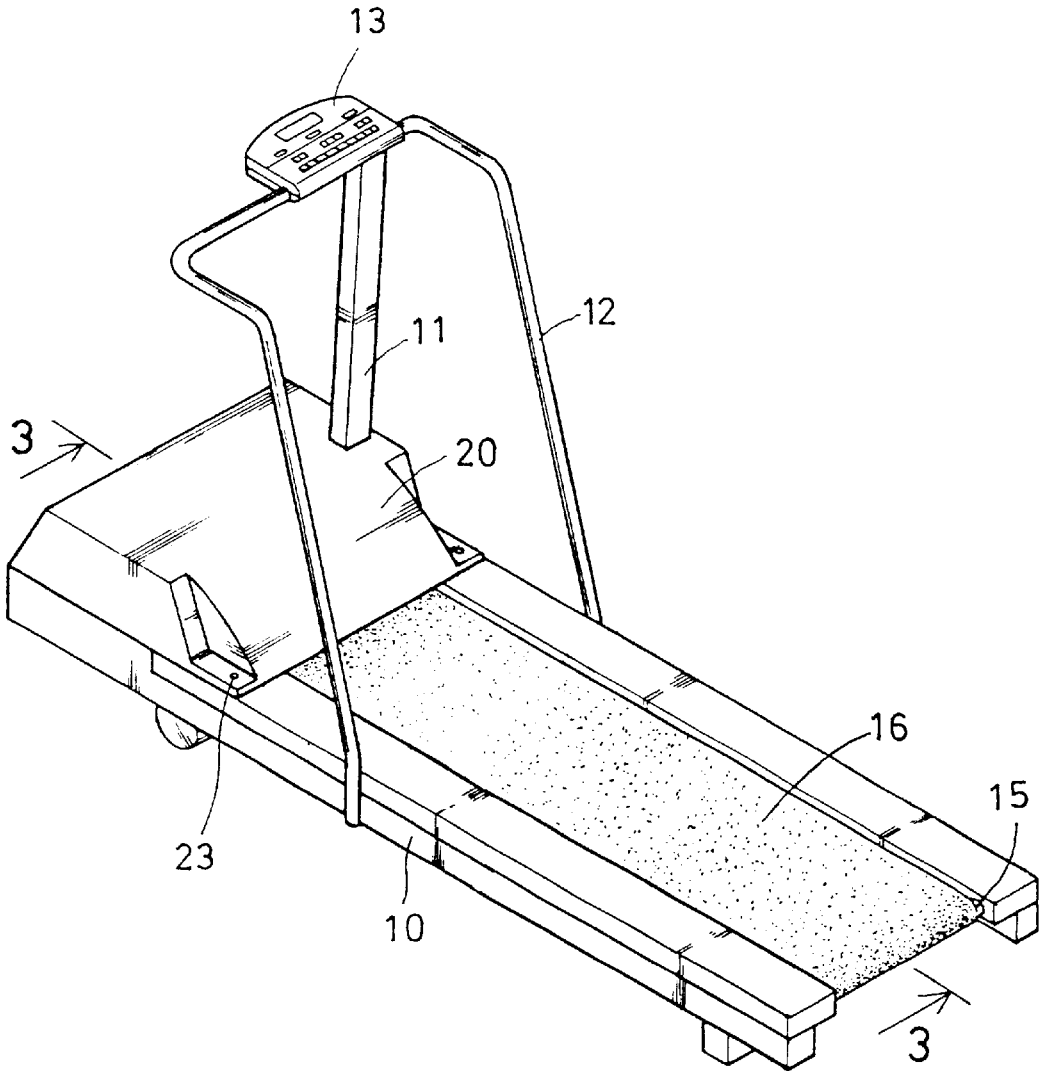
FIG. 1 is a perspective view of a treadmill in accordance with the present invention.
Figure 2:
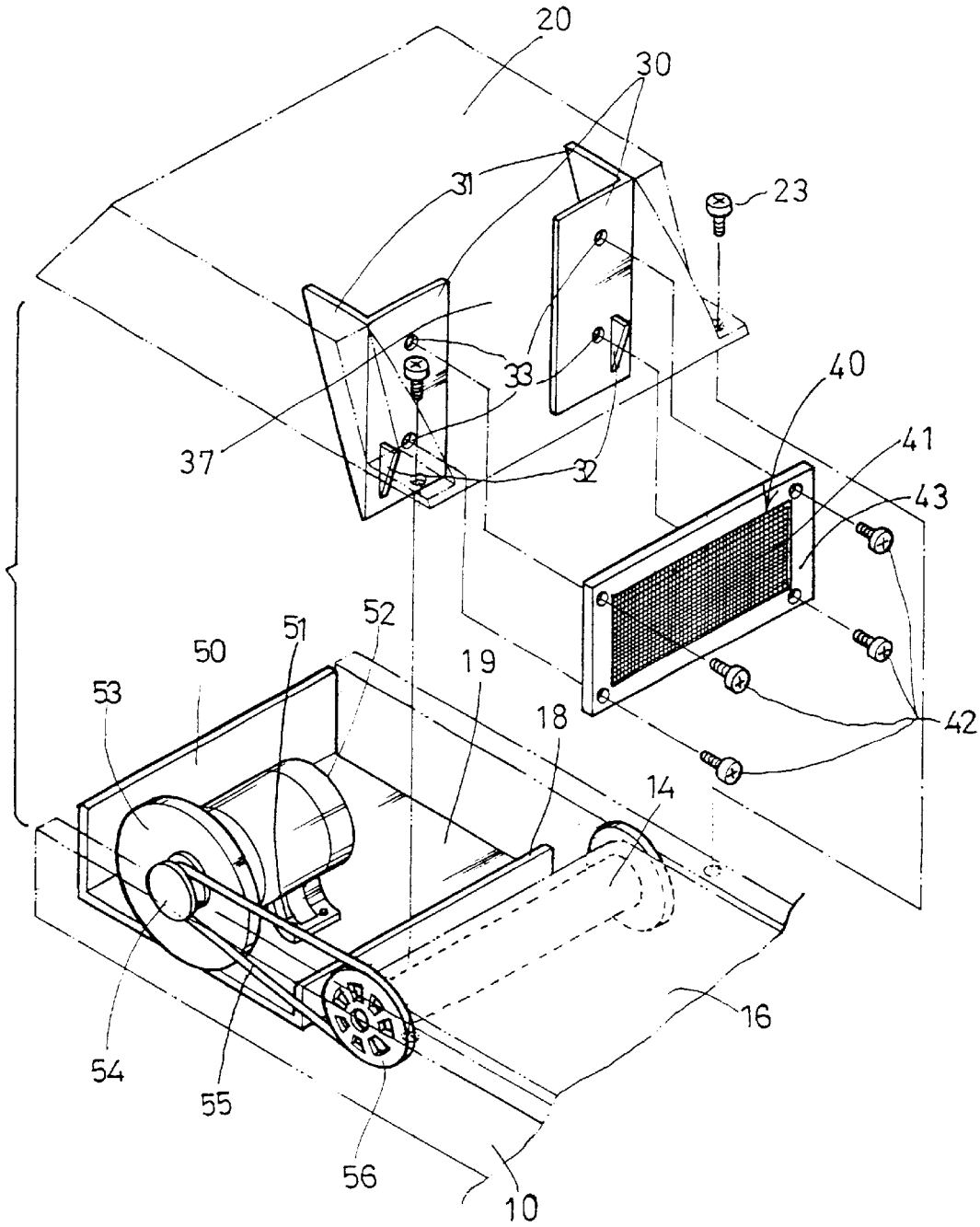
FIG. 2 is a partial exploded view of the treadmill.

Referring to the drawings, a treadmill in accordance with the present invention comprises a base 10 including a post 11 disposed or extended upward from the front portion thereof, a handle 12 attached or secured to the post 11, and a control device or a displayer 13 is disposed above the post 11 for controlling the operation of the treadmill. A roller 14 is rotatably secured and supported in the middle portion of the base 10, and another roller 15 is rotatably secured and supported in one end, such as the rear portion of the base 10. An endless belt 16 is engaged over the rollers 14, 15. The base 10 includes a chamber 50 formed therein for receiving the endless belt 16 and the rollers 14, 15.

A motor 52 is secured in the chamber 50 and on the bottom board 19 of the base 10 with a bracket 51 and one or more fasteners, and is disposed and located in front of the endless belt 16, for example. The motor 52 may also be secured in the rear portion of the base 10. A weight or a wheel 53 is secured to the motor 52, such as secured to the spindle (not shown) of the motor 52, for being rotated and driven by the motor 52. A sprocket or pulley 54 is also secured to the motor 52, or secured to the wheel 53, so as to be rotated and driven by the motor 52. Another sprocket or pulley 56 is secured to the roller 14 and rotated in concert with the roller 14, and a chain or a belt 55 is engaged over the pulleys 54, 56, for allowing the roller 14 and thus the endless belt 16 to be rotated and driven by the motor 52. A fence 18 is disposed or provided in the chamber 50 of the base 10 and is located between the motor 52 and the endless belt 16.

A cover 20 is engaged onto the front portion of the base 10, and secured to the base 10 with fasteners 23, for covering or shielding the motor 52 and the other elements or parts. The cover 20 may also be used for partially shielding the front portion of the endless belt 16. Two plates or bars 30 are secured to the cover 20 or secured to the fence 18 with fasteners or by welding processes, and located or provided or vertically secured between the cover 20 and the bottom board 19 of the base 10, and located between the motor 52 and the endless belt 16, and spaced from each other by a gap or an opening 37. The bars 30 each includes one or more reinforcing stays or ribs 31 extended therefrom and secured to the cover 20 or the base 10, for reinforcing the bars 30.

A shielding and protecting device 40 is secured onto the bars 30 with fasteners 42, for example, and includes a screen 41 provided and supported in a peripheral frame 43. The fasteners 42 may be threaded with the screw holes 33 formed in the bars 30. The bars 30 may each include one or more stops or brackets 32 extended therefrom for engaging with the shielding and protecting device 40 and for maintaining or positioning the shielding and protecting device 40 to the bars 30 at the predetermined or required position. The screen 43 is aligned or partially aligned with the opening 37 between the bars 30, for shielding the motor 52 and for preventing the motor 52 from being dirtied by dust or the like that may be carried or transported into the chamber 50 of the base 10 by the endless belt 16 and/or by the users. Air is allowed to flow through the screen 43 to dissipating the heat that may be generated by the motor 52.

Figure 3:
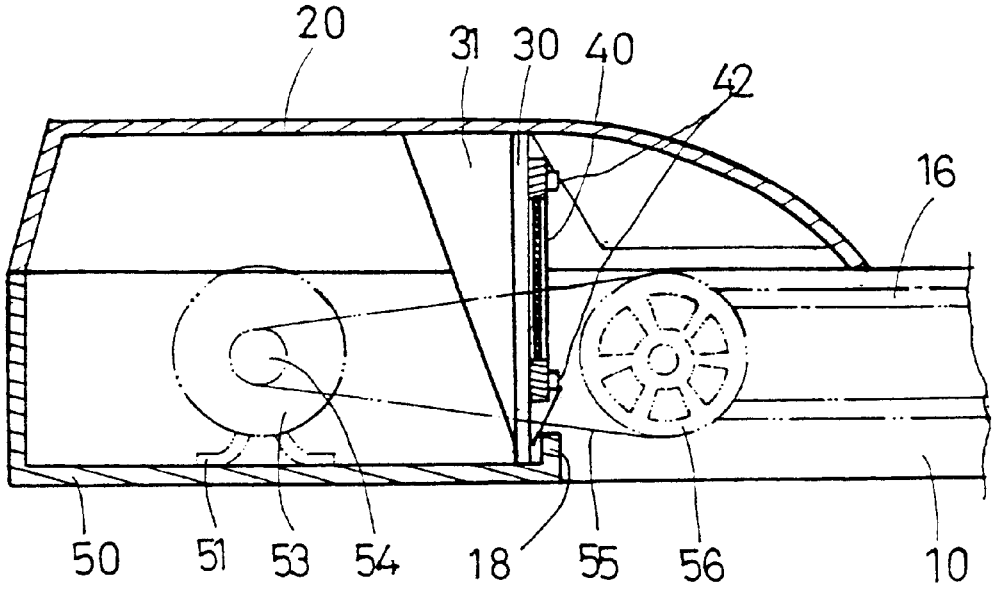
FIG. 3 is a partial cross sectional view taken along lines 3—3 of FIG. 1.

In operation, as shown in FIG. 3, when the endless belt 16 is driven by the motor 52, the dust or the like supported on or applied onto the endless belt 16 by the users may be caused or carried or transported into the space between the motor 52 and the endless belt 16. The shielding and protecting device 40 that is secured between the motor 52 and the endless belt 16 may be used to shield the motor 52 and to collect the dust and to prevent the motor 52 from being dirtied by dust or the like. The screen 43 allows the air to flow into the chamber 50 of the base 10 and to dissipating the heat that may be generated by the motor 52.

Accordingly, the treadmill in accordance with the present invention includes a shielding and protecting device for shielding the motor and for preventing the motor from being dirtied by dust or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a base including a middle portion, a first end portion and a second end portion, a first roller rotatably secured in said middle portion of said base, a second roller rotatably secured in said first end portion of said base, an endless belt engaged over said first roller and said second roller, a motor disposed in said second end portion of said base, and coupled to said first roller for driving said first roller and said endless belt, and a shielding device disposed between said motor and said endless belts said shielding device including a frame, and a screen engaged in said frame and disposed between said motor and said endless belt, for shielding said motor, and for preventing said endless belt to carry dust to dirt said motor.

2. The treadmill according to claim 1 further comprising a pair of bars provided in said base and disposed between said motor and said endless belt, said shielding device being secured onto said bars.

3. The treadmill according to claim 2, wherein said base includes a fence provided between said motor and said endless belt, said bars are secured onto said fence.

4. The treadmill according to claim 2, further comprising a cover secured onto said second end portion of said base, said bars being secured onto said cover.

5. The treadmill according to claim 2, wherein said bars each includes at least one reinforcing rib extended therefrom for reinforcing purposes.

6. The treadmill according to claim 2, wherein said bars each includes a bracket extended therefrom for engaging with said shielding device and for positioning said shielding device to said bars.

* * * * *